US005191616A

United States Patent [19]

Yokoyama

[11] Patent Number: 5,191,616

[45] Date of Patent: Mar. 2, 1993

[54] ACOUSTIC APPARATUS

[75] Inventor: Kenji Yokoyama, Hamamatsu, Japan

[73] Assignee: Yamaha Corporation, Hamamatsu, Japan

[21] Appl. No.: 634,606

[22] Filed: Dec. 27, 1990

[30] Foreign Application Priority Data

Dec. 29, 1989 [JP] Japan ..... 1-344500

[51] Int. Cl.[5] ..... H03G 5/00; H04R 3/00; H03F 21/00

[52] U.S. Cl. ..... 381/98; 381/96; 381/121

[58] Field of Search ..... 381/28, 96, 120, 121, 381/98, 99, 100, 101, 103, 108, 381, 387

[56] References Cited

U.S. PATENT DOCUMENTS

| | | | |
|---|---|---|---|
| 2,887,532 | 5/1949 | Werner . | |
| 3,037,081 | 9/1954 | Carlsson . | |
| 3,590,284 | 6/1971 | Yamane | 381/98 |
| 3,657,480 | 4/1972 | Cheng et al. . | |
| 4,118,600 | 10/1978 | Stahl . | |
| 4,321,428 | 3/1982 | Seki | 381/120 |
| 4,382,158 | 5/1983 | Ohshita | 381/101 |
| 4,538,298 | 8/1985 | Bose | 381/98 |
| 4,593,405 | 6/1986 | Frye | 381/99 |
| 4,649,565 | 3/1987 | Kaizer et al. | 381/120 |
| 4,653,096 | 3/1987 | Yokoyama | 381/63 |
| 4,739,514 | 4/1988 | Short | 381/98 |
| 4,875,546 | 10/1989 | Kman | 181/160 |

FOREIGN PATENT DOCUMENTS

| | | | |
|---|---|---|---|
| 0181608 | 11/1985 | European Pat. Off. . | |
| 47-1010 | 1/1972 | Japan . | |
| 58-29295 | 2/1983 | Japan . | |
| 233E204 | 10/1983 | Japan . | |
| 0130007 | 6/1987 | Japan | 381/28 |
| 8610639 | 1/1988 | Netherlands | 381/28 |
| 2072993 | 3/1980 | United Kingdom . | |
| 2181916 | 4/1987 | United Kingdom | 381/28 |

OTHER PUBLICATIONS

Electronics World + Wireless World, vol. 95, No. 1644, Oct. 1989, p. 1020, right-hand column, lines 1-37; "Constant-voltage loudspeaker crossover", Lidgey, John.

R. E. Werner and R. M. Carrell, Application of Negative Impedance Amplifiers to Loudspeaker Systems, Journal of the Audio Engineering Society, Oct. 1958, vol. 6, No. 4.

Richard E. Werner, Effect of a Negative Impedance Source on Loudspeaker Performance, Journal of the Acoustical Society of America, Mar. 1957, vol. 29, No. 3.

Karl Erik Stahl, Synthesis of Loudspeaker Mechanical Parameters by Electrical Means: A New Method for Controlling Low-Frequency Loudspeaker Behavior, Journal of the Audio Engineering Society, Sep. 1981, vol. 29, No. 9.

Warner Clements, A New Approach to Loudspeaker Damping, Audio Engineering, Aug. 1951, vol. 35, No. 8.

A. N. Thiele, Loudspeakers in Vented Boxes: Part I, Journal of the Audio Engineering Society, May 1971, vol. 19, No. 5.

A. N. Thiele, Loudspeakers in Vented Boxes: Part II, Journal of the Audio Engineering Society, Jun. 1971, vol. 19, No. 6.

*Primary Examiner*—James L. Dwyer
*Assistant Examiner*—Jack Chiang
*Attorney, Agent, or Firm*—Spensley Horn Jubas & Lubitz

[57] ABSTRACT

An acoustic apparatus comprises a cabinet, and a loudspeaker unit having a pair of input terminal, a first and a second driving systems disposed in the cabinet. The acoustic apparatus is driven by an external power amplifier which normally constant-voltage-drives a conventional loudspeaker. The first driving system supplies the entire of a input driving signal to one input terminal of a loudspeaker unit and the second driving system supplies component signals of the input driving signal other than ones in the specific frequency band. As a result, driving systems drive the loudspeaker unit with the component signals of the input driving signal in the specific frequency band in cooperation with the external amplifier.

9 Claims, 5 Drawing Sheets

ACOUSTIC APPARATUS

BACKGROUND OF THE INVENTION

1. Field of the Invention

The present invention relates to an acoustic apparatus which can supply a specific frequency band component signal of a driving signal to a loudspeaker unit and, more particularly, to an acoustic apparatus which is arranged without using a passive dividing network, and is driven by a conventional external power amplifier unit like in a conventional apparatus using the passive dividing network.

2. Description of the Prior Art

As a conventional system for driving a multi-way loudspeaker system, e.g., the system having a woofer, squaker, tweeter, or the like, a dividing network system and a multi-amplifier system are known.

However, the dividing network system requires large-capacity LC real elements. For this reason, this network system poses the following problems:

(1) A reproduced sound is distorted by a magnetic distortion of an inductance element (in particular, the distortion is conspicuous when a cutoff frequency $f_c$ of a filter constituting a network is decreased).

(2) An element inevitably becomes large in size since a core of an inductance element must be increased in size to reduce the magnetic distortion.

(3) Serial resistances of a loudspeaker unit and a driving system are increased due to a resistance of a coil of an inductance element, and Q of the loudspeaker unit is increased and cannot be damped.

(4) In addition, an AC nonpolarized (bipolar) capacitor having a large capacitance is required. In general, tan $\delta$ is small, and precision of a capacitance (i.e., dividing precision) is also low.

(5) Since a load is not a pure resistance but a impedance of a loudspeaker is changed depending on a frequency, it is difficult to design network characteristics.

(6) When an attenuator or the like is arranged to adjust, e.g., frequency characteristics of an output sound pressure, damping characteristics or the like are further adversely influenced.

On the other hand, the multi-amplifier system can solve the problems in the dividing network system. However, the multi-amplifier system must systematically deal with the entire system including a channel divider, power amplifiers in units of frequency bands, and the like, and can never be a loudspeaker system in which a loudspeaker system and an amplifier can be arbitrarily selected, i.e., which can be driven by an amplifier selected by a user.

SUMMARY OF THE INVENTION

The present invention has been made in consideration of the conventional problems, and has as its object to provide an acoustic apparatus which constitutes a multi-way loudspeaker system without using an LC real element (passive) dividing network, and can be driven by a conventional power amplifier like in a conventional apparatus employing the passive dividing network system.

In order to achieve the above object, according to the present invention, in an acoustic apparatus which can supply a specific frequency component signal of a driving signal to a loudspeaker, one input terminal (i.e., a path between the one input terminal and a ground terminal of the loudspeaker is driven by the entire driving signal, and the other input terminal (i.e., a path between the other input terminal and the ground terminal) of the loudspeaker is driven by component signals other than the specific frequency component signal.

More specifically, as a driving signal source, a conventional power amplifier is used, the loudspeaker is differentially driven by a path from the conventional power amplifier, and a path (auxiliary path) for an auxiliary amplifier, which branches from the former path, and driving characteristics are set by the auxiliary path.

With the above arrangement, the loudspeaker is driven by a difference between the entire driving signal and component signals other than specific frequency component signal, i.e., the specific frequency component signal of the driving signal.

Therefore, the acoustic apparatus of the present invention is not particularly limited except that a frequency band of a driving signal source, e.g., a power amplifier includes all or part of the specific frequency band, and can be driven by a power amplifier desirably selected by a user.

Since the auxiliary amplifier is operated in cooperation with a driving amplifier, e.g., the conventional amplifier, it can be a relatively low-capacity and compact one, e.g., a compact IC. This merit is conspicuous especially when transfer characteristics T(s) of the auxiliary path satisfies $T(s)>0$, i.e., when the output from the auxiliary amplifier has the same polarity as that of the driving amplifier.

BRIEF DESCRIPTION OF THE DRAWINGS

FIGS. 8A to 8C are graphs showing transfer gain-frequency characteristics of auxiliary amplifier circuits in the system shown in FIG. 7.

DETAILED DESCRIPTION OF THE PREFERRED EMBODIMENTS

Figure 1:
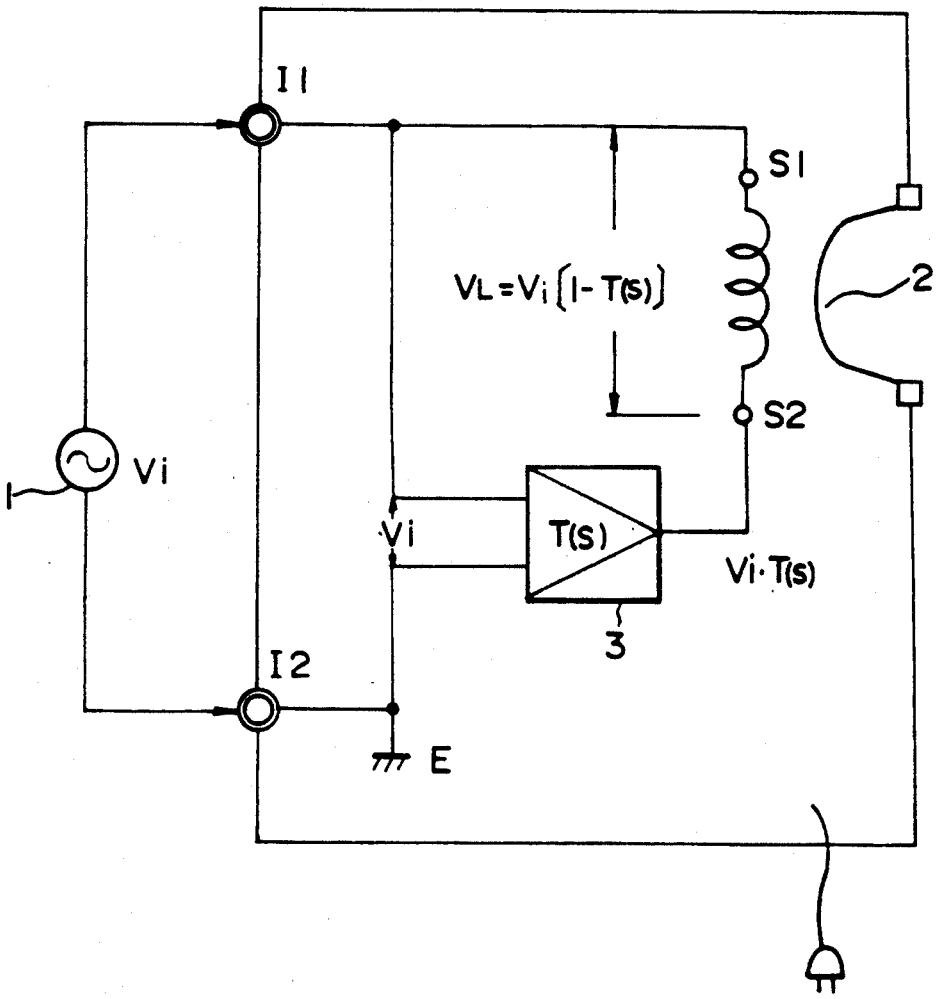
FIG. 1 is a circuit diagram showing a basic arrangement of an acoustic apparatus according to an embodiment of the present invention.

Preferred embodiments of the present invention will be described below with reference to the accompanying drawings. Note that the same reference numerals denote common or corresponding parts throughout the drawings.

FIG. 1 shows a basic arrangement of an acoustic apparatus according to an embodiment of the present invention. This acoustic apparatus drives a loudspeaker unit 2 having a pair of input terminals S1 and S2 by a specific frequency component signal of a driving signal Vi supplied from a conventional power amplifier (constant-voltage-driving amplifier) 1 through a pair of connection terminals I1 and I2. One input terminal S1 of the loudspeaker unit 2 is connected to one connection terminal I1, and the other connection terminal I2 is connected to an operation reference potential (ground) terminal E of an auxiliary amplifier circuit 3. The input terminal of the auxiliary amplifier circuit 3 is connected to one connection terminal I1, and its output terminal is connected to the other input terminal S2 of the loudspeaker unit 2.

The auxiliary amplifier circuit 3 has transfer gain-frequency characteristics T(s) corresponding to the specific frequency band, and generates an output Vo given by Vo=Vi·T(s) in response to an input signal Vi. The loudspeaker 2 receives the driving signal Vi at its one input terminal S1, and receives the output Vo=Vi·T(s) from the auxiliary amplifier circuit 3 at the other input terminal S2. Therefore, the loudspeaker unit 2 is driven by a signal VL given by:

$$VL = Vi - Vo = Vi[1 - T(s)]$$

From this equation, loudspeaker driving characteristics as a target for driving the loudspeaker unit 2, i.e., transfer characteristics G(s) from driving signal source connection terminals I1 and I2 to input terminals S1 and S2 of the loudspeaker unit 2 are given by G(s)=1−T(s).

Figure 2A:
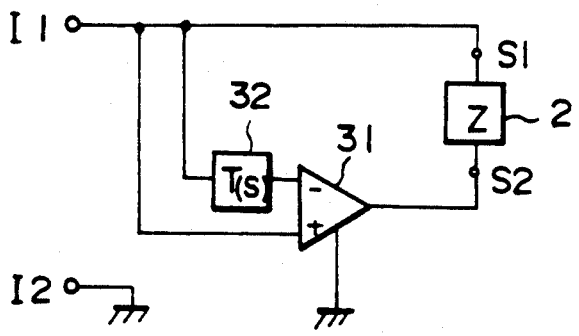
FIGS. 2A and 2B are circuit diagrams showing in detail an auxiliary amplifier circuit shown in FIG. 1.
Figure 2B:
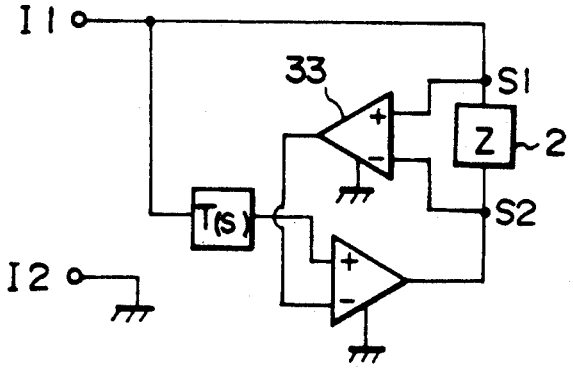

FIGS. 2A and 2B show the auxiliary amplifier circuit having such transfer characteristics. The auxiliary amplifier circuit 3 shown in FIG. 2A is constituted by a loudspeaker driving auxiliary amplifier 31 of a gain "1", and a transfer characteristic providing circuit 32 connected in series with the input terminal of the auxiliary amplifier 31. Transfer characteristics of the transfer characteristic providing circuit 32 are set to be T(s). In the auxiliary amplifier circuit 3 shown in FIG. 2B, a voltage feedback amplifier 33 is added to the circuit shown in FIG. 2A. For example the voltage feed amplifier 33 can be used as a DC servo amplifier by constituting an integrating circuit in its inverting input side of the amplifier 33.

Figure 3A:
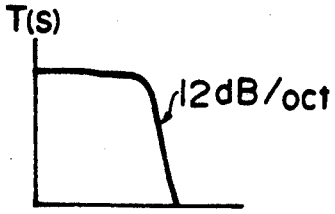
FIGS. 3A and 3B are graphs for explaining the relationship between transfer characteristics T(s) of a transfer characteristic providing circuit shown in FIG. 2A and loudspeaker driving characteristics G(s) obtained thereby.
Figure 3B:
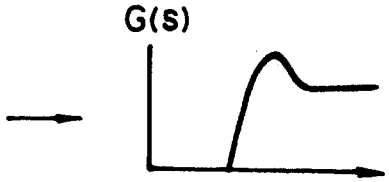

In general, when T(s) gives quadratic or higher-order characteristics, it is difficult to directly generate the transfer gain frequency characteristics G(s)=1−T(s). For example, even when T(s) is expressed by quadratic high-frequency cutoff characteristics shown in FIG. 3A, characteristics G(s) make a complex change, as shown in FIG. 3B. In this case, the transfer characteristic providing circuit 32 can be realized characteristics T(s) and G(s) by an active circuit. When active characteristics are realized, the auxiliary amplifier 31 or feedback amplifier may also be used as an active element. Even when T(s) is expressed by linear characteristics, the transfer characteristic providing circuit 32 can be arranged in a feedback system of the auxiliary amplifier 31.

Figure 4:
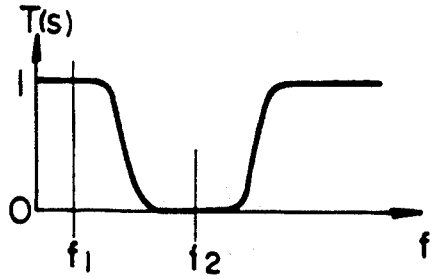
FIG. 4 is a graph showing a transfer gain-frequency characteristics given to the auxiliary amplifier circuit by the apparatus shown in FIG. 1.

An operation performed when transfer gain-frequency characteristic T(s) of the auxiliary amplifier circuit 3 is set as a band-elimination characteristic shown in FIG. 4 in the acoustic apparatus shown in FIG. 1 will be described bellow.

Figure 5A:
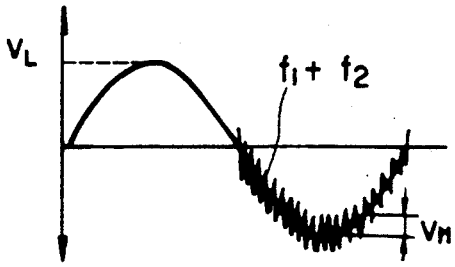
FIGS. 5A to 5C are voltage waveform charts of the respective portions in the apparatus shown in FIG. 1.
Figure 6A:
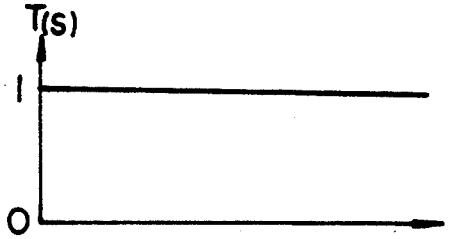
FIGS. 6A to 6C are graphs showing signals corresponding to FIGS. 5A to 5C as transfer gain frequency characteristics.
Figure 5B:
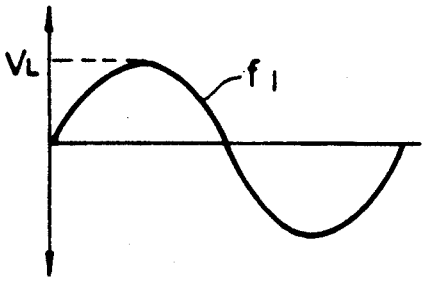
Figure 6B:
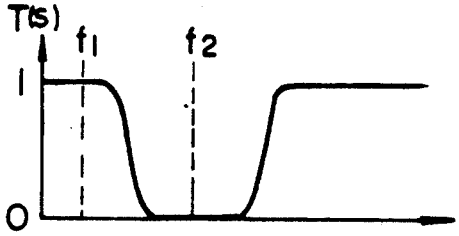
Figure 5C:
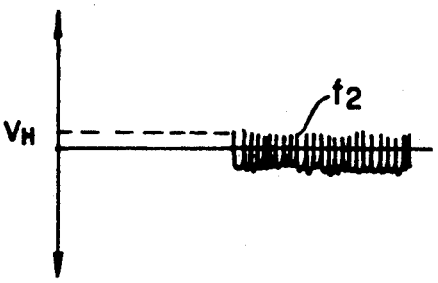
Figure 6C:
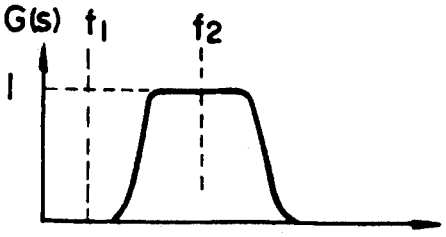

In FIG. 1, when a signal including a low-frequency component f1 and a component f2 (middle-frequency component) in the attenuation band shown in FIG. 5A is applied across the drive signal source connection terminals I1 and I2, i.e., across the loudspeaker input terminal S1 and the ground terminal E, the auxiliary amplifier circuit 3 amplifies only the signal component f1 in a pass band with the gain "1", and outputs the amplified component. Therefore, a signal consisting of only the low-frequency component f1 shown in FIG. 5B as an output from the auxiliary amplifier circuit 3 is applied across the loudspeaker input terminal S2 and the ground terminal E. Thus, a signal obtained by subtracting the signal shown in FIG. 5B from the signal shown in FIG. 5A, i.e., a component signal consisting of only the middle-frequency component f2 shown in FIG. 5C is applied across the two input terminals of the loudspeaker unit 2. FIGS. 6A to 6C show the transfer gain-frequency characteristics G(s) or T(s) of the respective portions corresponding to the waveforms shown in FIGS. 5A to 5C.

In this manner, in the apparatus shown in FIG. 1, a driving signal in the attenuated band by auxiliary amplifier circuit 3 is applied to the loudspeaker unit 2. By properly selecting the attenuation band of the auxiliary amplifier circuit 3, the loudspeaker unit 2 can be driven by a desired frequency component signal of the driving signal.

Since the auxiliary amplifier circuit 3 has a small transfer gain in a band where a driving current of the loudspeaker unit 2 (i.e., an output current of the auxiliary amplifier curcuit 3) is large, an output voltage is attenuated and has a small amplitude. Contrary to this, in a pass band where the output voltage has a large amplitude, the driving current of the loudspeaker unit 2 is decreased. Therefore, the auxiliary amplifier circuit 3 has relatively low power consumption, and need only a relatively small-capacity and compact one.

Figure 7:
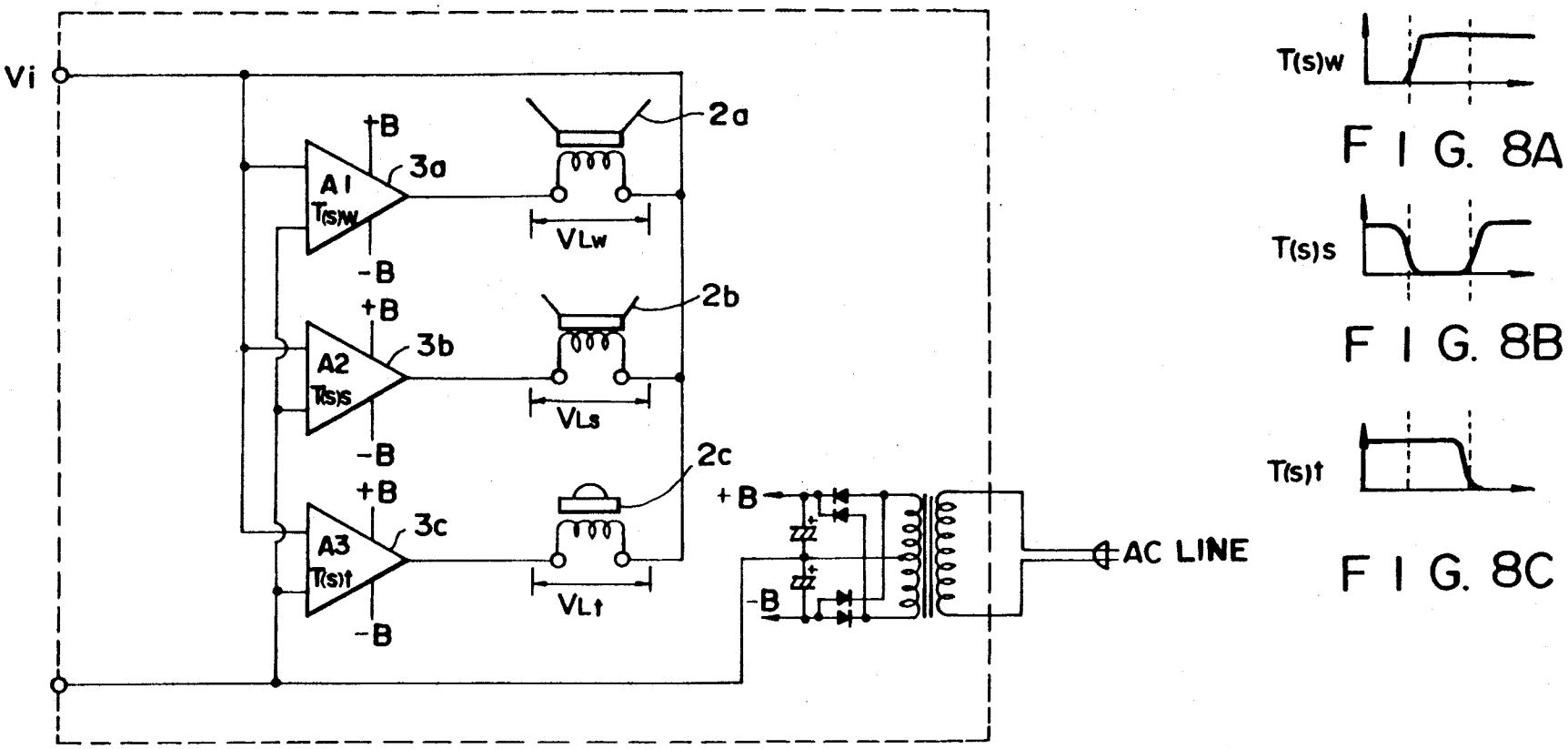
FIG. 7 is a circuit diagram of a three-way loudspeaker system according to another embodiment of the present invention.

FIG. 7 shows an embodiment wherein the present invention is applied to a three-way loudspeaker system.

In FIG. 7, an auxiliary amplifier circuit 3*a* is a high-pass filter (HPF) which has transfer characteristics T(s)w shown in FIG. 8A, i.e., has, of a driving signal Vi to be supplied to driving signal connection terminals I1 and I2, a driving signal band of a woofer 2*a* as an attenuation band, and other driving signal bands as pass bands of a transfer gain "1". Auxiliary amplifier circuits 3*b* and 3*c* are respectively a band-elimination filter (BEF) and a low-pass filter (LPF) having transfer characteristics T(s)s and T(s)t, as shown in FIGS. 8B and 8C, i.e., having driving signal bands of a squaker 2*b* and a tweeter 2*c* as attenuation bands and other signal bands as pass bands, respectively.

According to this arrangement, as described above, the driving signal Vi is supplied to the respective loudspeakers unit 2 (2*a*, 2*b*, 2*c*) with a transfer gain given by:

$$G(s)x = \frac{VLx}{Vi} = 1 - T(s)x$$

(for $x = w, s, t$)

More specifically, the driving signal Vi is divided into bands, and corresponding component signals VLw, VLs, and VLt are supplied to the respective loudspeakers. That is, a low-frequency component as a component signal in a band which is not attenuated by signal bands from the HPF 3*a* is supplied to the woofer 2*a*, a middle-frequency component as a component signal in a band which is not attenuated by signal bands from the BEF 3*b* is supplied to the squaker 2*b*, and a high-frequency component as a component signal in a band which is not attenuated by signal bands from the LPF 3*c* is supplied to the tweeter 2*c*.

In the system shown in FIG. 7, the transfer gains T(s) of the auxiliary amplifiers 3*a*, 3*b*, and 3*c* are set to be "1" in the pass bands, are set to be "0" in the attenuation bands, and become positive over all the bands. However, the gains may be set to be values other than 1 and 0 in correspondence with efficiency of each loudspeaker unit 2. A variable element such as a variable resistor (attenuator) may be arranged at the input side of each of the auxiliary amplifier circuits 3*a*, 3*b*, and 3*c* or in the feedback loop to vary the transfer gain T(s), thereby allowing adjustment of, e.g., frequency characteristics. Furthermore, the transfer gain T(s) may be set to be negative in the attenuation band (i.e., a speaker driving band). In this case, the auxiliary amplifier circuit 3 and the conventional power amplifier for supplying the driving signal Vi perform negative impedance driving (disclosed in European Patent Application Publication No. 0322686) in cooperation with each other, thereby improving reproduction characteristics of the loudspeaker unit 2 as compared to that in so-called constant voltage driving.

Figure 9:
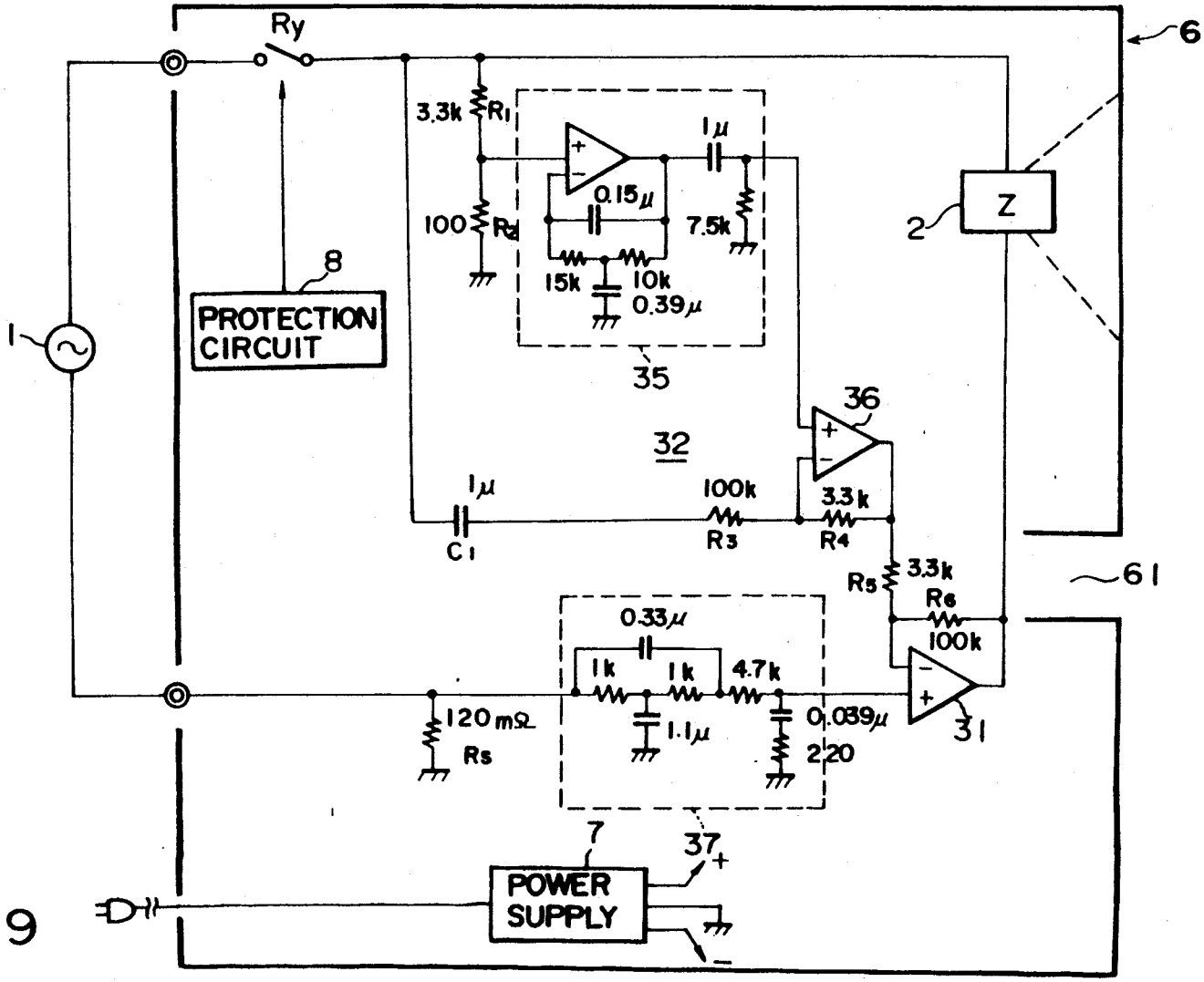
FIG. 9 is a circuit diagram of a loudspeaker system with a resonance duct port according to still another embodiment of the present invention.

FIG. 9 shows an embodiment wherein the present invention is applied to a loudspeaker system with a resonance duct port.

In a system shown in FIG. 9, a loudspeaker unit 2 and an auxiliary amplifier circuit 3 as the characteristic feature of the present invention are housed in a cabinet having a resonance duct port 61. A DC power supply circuit 7 for operating the auxiliary amplifier circuit 3, and a protection circuit 8 for protecting the respective portions of the circuit from being deteriorated or broken due to an overload or an abnormal operation are also incorporated in the same cabinet 6. The auxiliary amplifier 3 negative-impedance drives the loudspeaker unit 2 in cooperation with an external power amplifier 1 as a driving signal source.

In FIG. 9, the auxiliary amplifier circuit 3 comprises a driving amplifier 31, a transfer characteristic providing circuit 32, a feedback circuit 37, and a loudspeaker current detection resistor Rs.

In the transfer characteristic providing circuit 32, a voltage dividing circuit including resistors R1, R2, divides a driving signal Vi at a voltage dividing ratio k ($k=R2/(R1+R2)$). An equalizer circuit 35 provides transfer characteristics T(s) to an output k*Vi from the voltage dividing circuit. A buffer amplifier 36 amplifies an output k*Vi*T(s) from the equalizer circuit 35 with a gain $(R3+R4)/R3\simeq 1$, and amplifies the driving signal Vi supplied to its inverting input terminal through a coupling capacitor C1 and a resistor R3 with a gain $-[R4/(R3+R4)]\simeq -k$, thereby generating an output given by:

$$k*Vi*T(s)-k*Vi=k[T(s)-1]*Vi$$

More specifically, the transfer gain of this transfer characteristic providing circuit 32 is $k[T(s)-1]$.

The driving amplifier 31 amplifies the output from the transfer characteristic providing circuit 32 with a gain $-[(R5+R6)/R5]\simeq -(1/k)$. Thus, the transfer gain of the auxiliary amplifier circuit 3 is $1-T(s)$. $1-T(s)$ is caused to coincide with desired loudspeaker driving characteristics G(s), thereby applying a desired frequency component signal of the driving signal Vi to the loudspeaker unit 2.

In the system shown in FIG. 9, a current flowing through the loudspeaker unit 2 is detected by the loudspeaker current detection resistor Rs connected in series with the external power amplifier (constant-voltage-driving amplifier) 1 and the loudspeaker unit 2, and is applied to the noninverting input terminal of the driving amplifier 31 via the feedback circuit 37 of a transfer gain $\beta$. In this manner, a voltage across the current detection resistor Rs is multiplied with $\beta$, and the product is added (positively fed back) to the output $[1-T(s)]*Vi$, so that an output impedance Zo of the auxiliary amplifier circuit 3 is given by:

$$Zo=Rs(1-A\beta)$$

(for $A=(R5+R6)/R5$)

Since $\beta\simeq 1$ at a sufficiently low frequency, $A\beta>>1$ is satisfied, and the output impedance Zo serves as a negative impedance.

Thus, in a low-frequency band, negative resistance driving disclosed in European Patent Application Publication No. 0322686 is executed, and the loudspeaker unit 2 is very strongly driven and damped, thus improving reproduction characteristics of the loudspeaker unit, in particular, bass-band characteristics. In addition, the cabinet 6 and the entire loudspeaker system can be rendered compact without impariring reproduction characteristics of the loudspeaker system.

As the protection circuit 8, there can be used a known circuit having known functions, such as a DC protection function for turning off a relay contact Ry when a DC current beyond a predetermined value flows through the loudspeaker unit, an overcurrent protection function for turning off the relay contact Ry when an overcurrent flows through the loudspeaker unit, a heat sink temperature protection function for turning off a relay contact Ry1 when a heat sink temperature exceeds a predetermined value, a power supply muting function for turning on the relay contact Ry after a predetermined delay time upon power-on to prevent noise generation due to a transient response upon power-on, or a circuit or the loudspeaker from being deteriorated or broken, and the like. Alternatively, a protection means such as a primary fuse, an intra-transformer temperature fuse, or the like may be arranged.

What is claimed is:

1. An acoustic apparatus for supplying a specific frequency band of a driving signal to a loudspeaker unit having a pair of input terminals, to electro-acoustically transducer comprising:

a first driving system for supplying the entire driving signal to one input terminal of said loudspeaker unit; and a second driving system for removing frequency components corresponding to the specific frequency band from the entire driving signal and producing a modified driving signal, the second driving system supplying the modified driving signal to the other terminal of said loudspeaker unit, wherein said second driving system includes a driving amplifier for driving said loudspeaker unit, a current detection means for detecting a current flowing through said loudspeaker unit, and a feedback means for feeding back the detected current to said driving amplifier;

whereby a voltage signal corresponding to the specific frequency band is provided between the pair of input terminals of the loudspeaker.

2. An apparatus according to claim 1, wherein said driving signal is supplied by a constant-voltage-driving amplifier.

3. An acoustic apparatus comprising:

a pair of driving signal source connection terminals for supplying a driving signal having a plurality of frequency bands;

a loudspeaker having a pair of input terminals, one of which is connected to one of said driving signal source connection terminals; and an auxiliary amplifier circuit having an output terminal which is connected to the other input terminal of said loudspeaker, and an operation reference potential terminal which is connected to the other one of said driving signal source connection terminals, for outputting a signal containing components outside a specific one of said plurality of frequency bands;

wherein said loudspeaker unit is driven by a signal containing components within the specific frequency band of the driving signal.

4. An apparatus according to claim 3, wherein said pair of driving signal source connection terminals are provided by a driving signal source comprising a constant-voltage-driving amplifier.

5. An apparatus according to claim 3, wherein said auxiliary amplifier circuit comprises a transfer characteristic providing circuit having a filtering characteristic.

6. An apparatus according to claim 5, wherein said transfer characteristic providing circuit is an active circuit.

7. An apparatus according to claim 5, wherein said auxiliary amplifier circuit comprises a driving amplifier for driving said loudspeaker unit, a current detection means for detecting a current flowing through said loudspeaker unit, and a feedback means for feeding back the detected current to said driving amplifier.

8. An apparatus according to claim 3, wherein said auxiliary amplifier circuit and said loudspeaker unit are disposed in a cabinet.

9. An apparatus according to claim 8, wherein said cabinet constitutes a resonator with a resonance duct port.

* * * * *